US010737485B2

(12) United States Patent
Gygi et al.

(10) Patent No.: US 10,737,485 B2
(45) Date of Patent: Aug. 11, 2020

(54) SHEET-FED STAMPING PRESS COMPRISING A FOIL LAMINATING UNIT

(71) Applicant: KBA-NOTASYS SA, Lausanne (CH)

(72) Inventors: Matthias Gygi, Schmitten (CH); Regina Bauer, Thüngersheim (DE); Björn Kriege, Veitshöchheim (DE)

(73) Assignee: KBA-NOTASYS SA, Lausannne (CH)

( * ) Notice: Subject to any disclaimer, the term of this patent is extended or adjusted under 35 U.S.C. 154(b) by 116 days.

(21) Appl. No.: 15/769,598

(22) PCT Filed: Nov. 3, 2016

(86) PCT No.: PCT/IB2016/056617
§ 371 (c)(1),
(2) Date: Apr. 19, 2018

(87) PCT Pub. No.: WO2017/077477
PCT Pub. Date: May 11, 2017

(65) Prior Publication Data

US 2018/0304613 A1 Oct. 25, 2018

(30) Foreign Application Priority Data

Nov. 5, 2015 (EP) ..... 15193276

(51) Int. Cl.
*B41F 19/06* (2006.01)
*B41F 16/00* (2006.01)
*B41F 19/00* (2006.01)

(52) U.S. Cl.
CPC ..... *B41F 16/0026* (2013.01); *B41F 16/0013* (2013.01); *B41F 16/0066* (2013.01); *B41F 19/001* (2013.01); *B41P 2219/50* (2013.01)

(58) Field of Classification Search
CPC ..... B41F 16/0013; B41F 16/0026; B41F 16/0066; B41F 19/001; B41P 2219/50
See application file for complete search history.

(56) References Cited

U.S. PATENT DOCUMENTS 5,368,680 A 11/1994 Mitsam
5,979,308 A 11/1999 Kägi et al.
(Continued)

FOREIGN PATENT DOCUMENTS

DE 32 10 551 10/1983
DE 44 07 618 9/1995
(Continued)

OTHER PUBLICATIONS

International Search Report and Written Opinion of the ISA for PCT/IB2016/056617, dated Mar. 17, 2017, 14 pages.
(Continued)

*Primary Examiner* — Matthew G Marini
*Assistant Examiner* — Marissa Ferguson-Samreth
(74) *Attorney, Agent, or Firm* — Nixon & Vanderhye P.C.

(57) ABSTRACT

There is described a sheet-fed stamping press (10*) comprising a foil application unit (2*) designed to allow transfer or lamination of foil material onto successive sheets (S), which foil material is fed to the foil application unit (2*) in the form of a foil carrier (FC) supplied by means of a foil feeding system (3). The foil application unit (2*) comprises a stamping cylinder (21) with at least one circumferential stamping section (210) provided on a circumference of the stamping cylinder (21) and comprising successive stamping segments (211*; 211) distributed one after the other about the circumference of the stamping cylinder (21), the stamping cylinder (21) also acting as sheet-transporting cylinder and comprising multiple sheet holding units (21***a*) distributed about the circumference of the stamping cylinder (21) and designed to hold successive sheets (S) against the circumference of the stamping cylinder (21). The foil application unit (2*) further comprises a plurality of counter-pressure units (25) distributed about a portion of the circumference of the stamping cylinder (21) and designed to
(Continued)

press the successive sheets (S) and the foil carrier (FC) against an outer surface of the stamping segments (211*; 211), the foil carrier (FC) being supplied by the foil feeding system (3) between the sheets (S) and the stamping segments (211*; 211**). Each counter-pressure unit (25) is designed as a cylinder unit (250, 255) provided with at least one circumferential pressing element (255) positioned to cooperate with the circumferential stamping section (210) of the stamping cylinder (21), and the counter-pressure units (25) are driven into rotation by means of at least one dedicated drive (26**).

16 Claims, 6 Drawing Sheets

(56) References Cited

U.S. PATENT DOCUMENTS

| | | | |
|---|---|---|---|
| 6,112,651 | A | 9/2000 | Eitel et al. |
| 7,424,903 | B2 | 9/2008 | Kägi et al. |
| 7,971,619 | B2 | 7/2011 | Eitel et al. |
| 8,628,187 | B2 | 1/2014 | Roof et al. |
| 2007/0181260 | A1 | 8/2007 | Mitsam et al. |
| 2010/0148428 | A1 | 6/2010 | Kägi et al. |
| 2011/0265671 | A1 | 11/2011 | Brendle |
| 2015/0151528 | A1 | 6/2015 | Shimizu et al. |
| 2015/0314580 | A1 | 11/2015 | Sato et al. |

FOREIGN PATENT DOCUMENTS

| | | | | |
|---|---|---|---|---|
| DE | 4407618 | * | 9/1995 | ..... B65H 18/16 |
| EP | 0 469 433 | | 7/1991 | |
| EP | 0 582 178 | | 7/1993 | |
| EP | 0 582 178 | | 2/1994 | |
| EP | 0 858 888 | A2 | 8/1998 | |
| EP | 1 593 503 | A | 11/2005 | |
| EP | 2 962 835 | | 1/2016 | |
| FR | 2 412 057 | | 2/2011 | |
| JP | 04-226737 | | 8/1992 | |
| JP | 06-166168 | | 6/1994 | |
| JP | 07-247043 | | 9/1995 | |
| JP | 2005-059340 | | 3/2005 | |
| JP | 2005-0593340 | | 3/2005 | |
| JP | 2007-533506 | | 11/2007 | |
| JP | 2008-502560 | | 1/2008 | |
| JP | 2010-521319 | | 6/2010 | |
| JP | 2015-528754 | | 10/2015 | |
| KR | 2012-0028270 | | 3/2012 | |
| RU | 2 329 540 | | 7/2008 | |
| WO | WO 94/13487 | | 6/1994 | |
| WO | WO 97/35721 | | 10/1997 | |
| WO | WO 97/35794 | | 10/1997 | |
| WO | WO 97/35795 | | 10/1997 | |
| WO | WO 97/36756 | | 10/1997 | |
| WO | WO 2003/043823 | | 5/2003 | |
| WO | 2005/102733 | | 11/2005 | |
| WO | WO 2005/102733 | | 11/2005 | |
| WO | 2005/120832 | | 12/2005 | |
| WO | WO 2005/120832 | | 12/2005 | |
| WO | 2006/005434 | | 1/2006 | |
| WO | 2008/028309 | A1 | 3/2008 | |
| WO | 2008/104904 | | 9/2008 | |
| WO | WO 2008/104904 | | 9/2008 | |
| WO | WO 2009/112989 | | 9/2009 | |
| WO | 2009/143644 | A1 | 12/2009 | |
| WO | WO 2010/001317 | | 1/2010 | |
| WO | WO 2013/190048 | | 12/2013 | |
| WO | WO 2014/132764 | | 9/2014 | |

OTHER PUBLICATIONS

Sina Ebnesajjad, Characteristics of Adhesive Materials, 2011, pp. 137-183.

Office Action issued in RU Appln. No. 2018112997/12 dated Mar. 7 2019 w/ partial translation).

* cited by examiner

SHEET-FED STAMPING PRESS COMPRISING A FOIL LAMINATING UNIT

This application is the U.S. national phase of International Application No. PCT/IB2016/056617 filed 3 Nov. 2016, which designated the U.S. and claims priority to EP Patent Application No. 15193276.1 filed 5 Nov. 2015, the entire contents of each of which are hereby incorporated by reference.

TECHNICAL FIELD

The present invention generally relates to a sheet-fed stamping press. More precisely, the present invention relates to a sheet-fed stamping press as defined in the preamble of claim 1 hereof. The present invention is in particular applicable for the production of security documents, such as banknotes.

BACKGROUND OF THE INVENTION

Sheet-fed stamping presses, especially such stamping presses that are adapted to carry out hot-stamping of foil material are known in the art, for instance from International (PCT) Publications Nos. WO 97/35721 A1, WO 97/35794 A1, WO 97/35795 A1, WO 97/36756 A1, WO 03/043823 A1, WO 2005/102733 A2 and WO 2008/104904 A1, which publications are incorporated herein by reference in their entirety.

FIG. 1 is an illustration of a known sheet-fed stamping press, designated globally by reference numeral 10, as discussed in the aforementioned publications. This sheet-fed stamping press 10 is designed for performing hot-stamping of foil material onto successive sheets S which are fed from a sheet feeder 1 supplying individual sheets S in succession from a sheet feeding pile 15 for processing in a downstream-located foil application unit 2. This foil application unit 2 is designed in the present illustration to allow transfer by hot-stamping of foil material onto the successive sheets S, which foil material is conventionally fed to the foil application unit 2 in the form of a continuous band by means of a foil feeding system 3. More precisely, the foil material to be transferred onto the sheets S is provided on a suitable foil carrier FC, which is brought into contact with the surface of the sheets S so as to allow transfer of the foil material from the foil carrier FC onto the sheets S under the combined application of heat and pressure.

Alternatively, the foil application unit 2 could be adapted to allow lamination of foil material as for instance disclosed in International (PCT) Publication No. WO 2008/104904 A1 (see also International (PCT) Publications Nos. WO 2009/112989 A1 and WO 2010/001317 A1, which are likewise incorporated herein by reference in their entirety). In this case, at least a part of the foil carrier FC is laminated onto the sheets S as part of the applied foil material.

The foil application unit 2 comprises a heated stamping cylinder 21 with at least one, usually multiple circumferential stamping sections 210 (see FIG. 2) that are provided on a circumference of the stamping cylinder 21. In the illustrated example, one will appreciate that the stamping cylinder 21 actually comprises a plurality of (namely six) circumferential stamping sections 210 that are provided on the circumference of the stamping cylinder and distributed axially along an axis of rotation of the stamping cylinder 21 (i.e. along direction x in FIG. 2) at a plurality of axial positions, which axial positions correspond to different columns of security imprints that are present on the sheets S.

Each circumferential stamping section 210 actually comprises successive stamping segments 211 that are distributed one after the other about the circumference of the stamping cylinder 21 (i.e. along the circumferential direction y in FIG. 2). In the illustrated example, the stamping cylinder 21 is a four-segment cylinder and each stamping section 210 accordingly comprises four such stamping segments 211, which are conventionally designed as individual stamping segments that are secured at both ends in corresponding cylinder pits 21*b* as discussed in greater detail in International (PCT) Publication No. WO 2005/102733 A2.

As shown in FIGS. 1 and 2, four sets of sheet holding units 21*a* are distributed about the circumference of the stamping cylinder 21 in order to hold a leading edge of each successive sheet S that is fed to the stamping cylinder 21. These sheet holding units 21*a* can in particular be configured as suction units that are designed to hold the leading edge of a sheet S by suction. In the illustrated example, the sheet holding units 21*a* are integrated into a number of bridge elements 215 that are provided and secured in the cylinder pits 21*b* as illustrated in FIG. 2 and discussed in greater detail in International (PCT) Publication No. WO 2005/102733 A2.

The foil carrier FC is typically fed to the foil application unit 2 by means of the foil feeding system 3 that comprises one or more supply rolls 31 for the supply of the foil carrier FC and one or more winding-up rolls 32 for winding up used foil carrier, designated by reference numeral FC*. The particular structure of the foil feeding system 3 is not of major relevance in the context of the instant invention. It suffices to understand that the foil feeding system 3 is adapted to supply the foil carrier FC in register with the sheets S. More detailed information regarding the structure and operation of the foil feeding system 3 can be found for instance in International (PCT) Publication No. WO 94/13487 A1, which is incorporated herein by reference in its entirety.

In the aforementioned stamping press, it will be understood that the foil carrier FC is fed from the foil feeding system 3 to the stamping cylinder 21 between the circumferential stamping sections 210 and the sheets S that are fed from the sheet feeder 1.

As illustrated in FIG. 1, multiple counter-pressure rollers 22 are provided about a portion of the circumference of the stamping cylinder 21. More precisely, the counter-pressure rollers 22 are arranged in pairs and distributed about a lower portion of the circumference of the stamping cylinder 21 (in the illustrated example, three such pairs of counter-pressure rollers 22 are provided as shown in FIG. 1) so as to press the underside of the sheet S against the circumference of the stamping cylinder 21 and thereby ensure application of a suitable pressure between the foil carrier FC and the sheet S to cause transfer of the foil material from its carrier FC onto the sheet S. This transfer is also ensured through the application of heat applied via the stamping cylinder 21 that is heated up to a suitable temperature. The pairs of counter-pressure rollers 22 are typically constructed as individual counter-pressure unit each comprising its own pneumatic (or hydraulic) cylinder or piston 23 designed to press the counter-pressure rollers 22 against the circumference of the stamping cylinder 21, or more exactly against the circumference of the circumferential stamping sections 210. European Patent Publication No. EP 0 582 178 A1 and International (PCT) Publication No. WO 2005/120832 A1, which are incorporated herein by reference in their entirety, disclose further details of counter-pressure roller systems for stamping presses.

In the aforementioned context, as illustrated in FIG. 2, each stamping segment 211 of the circumferential stamping sections 210 typically comprises corresponding stamping surface(s) 211*a*, which come into contact with the foil carrier FC, as well as supporting tracks 211*b* located on either side of the stamping surface(s) 211*a*, which come into contact with the sheets S, outside of the region where the foil carrier FC is present, so as to provide continuous support for the counter-pressure rollers 22. As shown in FIG. 2, the supporting tracks 211*b* are aligned with the bridge elements 215 so as to provide uninterrupted support for the counter-pressure rollers 22 across the region of the cylinder pits 21*b*. In the illustration of FIG. 2, each stamping segment 211 includes a plurality of individual stamping surfaces 211*a*, which is typical for the application of individual patches of foil material onto the sheets S. In the event of a stripe application, each stamping segment 211 would typically include a single, continuous stamping surface 211*a* to cause transfer of a corresponding continuous stripe of foil material onto the sheets S.

Downstream of the foil application unit 2, there is typically provided a conveyor system 4 for conveying the sheets S and foil carrier FC, which is still attached to the sheets S, away from the stamping cylinder 21. This conveyor system 4 conventionally comprises conveyor belts or bands 41 and a cooling roller 42 about the circumference of which the sheets S and foil carrier FC are brought in order to cool-down the sheets S and foil carrier FC and thereby enhance adhesion of the foil material onto the sheets S prior to separation of the foil carrier FC. A foil detachment device 45 is also typically provided along the path of the conveyor system 4 so as to separate the foil carrier FC from the sheets S. The used foil carrier FC* is then wound up around the winding-up roll(s) 32 or possibly fed again upstream of the foil application unit 2 (which is typically done in case of patch application—see again International (PCT) Publication No. WO 94/13487 A1).

At a downstream end of the conveyor system 4, there is typically provided a suction drum 46 that works in conjunction with a downstream-located chain-gripper system to transport and deliver the processed sheets, designated by reference numeral S* for the sake of distinction, in a sheet delivery unit 5 of the stamping press 10. More precisely, the chain-gripper system consists of chain wheels 51, 52 driving a pair of endless chains 53 extending therebetween and holding spaced-apart gripper bars 54 designed to hold the processed sheets S* by a leading edge thereof and transport the processed sheets S* individually in order to be delivered on top of a sheet delivery pile 55. More than one delivery pile 55 may be provided.

A problem with the aforementioned sheet-fed stamping press resides in the fact that the counter-pressure rollers 22, which are pressed against the underside of the sheets S exert a braking force on the sheets S, which braking force may cause undesired movement or slippage of the sheets S with respect to the circumference of the stamping cylinder 21. Such movement or slippage of the sheets S in turn causes stress on the foil carrier FC and/or affects a proper register of the foil material with respect to the sheets S, which is not desired.

There is therefore a need to improve the known sheet-fed stamping presses.

SUMMARY OF THE INVENTION

A general aim of the invention is therefore to improve the known sheet-fed stamping presses.

More precisely, an aim of the present invention is to provide such a sheet-fed stamping press where sheet transport and foil application are improved.

These aims are achieved thanks to the sheet-fed stamping press defined in the claims.

There is accordingly provided a sheet-fed stamping press comprising a foil application unit designed to allow transfer or lamination of foil material onto successive sheets, which foil material is fed to the foil application unit in the form of a foil carrier supplied by means of a foil feeding system. The foil application unit comprises a stamping cylinder with at least one circumferential stamping section provided on a circumference of the stamping cylinder and comprising successive stamping segments distributed one after the other about the circumference of the stamping cylinder, the stamping cylinder also acting as sheet-transporting cylinder and comprising multiple sheet holding units distributed about the circumference of the stamping cylinder and designed to hold successive sheets against the circumference of the stamping cylinder. The foil application unit further comprises a plurality of counter-pressure units distributed about a portion of the circumference of the stamping cylinder and designed to press the successive sheets and the foil carrier against an outer surface of the stamping segments, the foil carrier being supplied by the foil feeding system between the sheets and the stamping segments. According to the invention, each counter-pressure unit is designed as a cylinder unit provided with at least one circumferential pressing element positioned to cooperate with the circumferential stamping section of the stamping cylinder, and the counter-pressure units are driven into rotation by means of at least one dedicated drive.

Preferably, the counter-pressure units are driven into rotation by means of a common drive. Alternatively, each counter-pressure unit is driven into rotation by means of a separate drive.

Advantageously, a rotational speed or angular position of each counter-pressure unit is adjustable with respect to a rotational speed or angular position of the stamping cylinder, which helps adjusting operation of the counter-pressure units to improve transport of the sheets and ensure optimal transfer of the foil material from the foil carrier onto the sheets.

In the context of an application where the sheets are provided with a matrix arrangement of multiple security imprints printed on the sheets comprising multiple columns of imprints, the stamping cylinder is configured to comprise a plurality of the circumferential stamping sections provided on the circumference of the stamping cylinder, which circumferential stamping sections are distributed axially along an axis of rotation of the stamping cylinder at a plurality of axial positions. Additionally, each counter-pressure unit is provided with a plurality of the circumferential pressing elements that are distributed axially along an axis of rotation of the cylinder unit at a plurality of axial positions corresponding to the axial positions of the circumferential stamping sections of the stamping cylinder. Furthermore, the foil feeding system is adapted to supply the foil carrier at a plurality of axial positions corresponding to the axial positions of the circumferential stamping sections.

Each stamping segment can comprise one or more stamping surfaces coming into contact with corresponding portions of the foil carrier. In one example, each stamping segment comprises a continuous stamping surface designed to allow application of a continuous stripe of foil material onto the successive sheets. In another example, each stamping segment comprises one or more individual stamping surfaces designed to allow application of one or more corresponding portions of foil material onto the successive sheets.

In accordance with a particularly preferred embodiment of the invention, a distance of each counter-pressure unit with respect to the circumference of the stamping cylinder is adjustable, which can conveniently be achieved by mounting each counter-pressure unit on eccentric bearings.

Such adjustment of the distance of the counter-pressure units with respect to the circumference of the stamping cylinder is particular advantageous in that supporting tracks on the stamping segments that typically come into contact with the successive sheets outside of the region where the foil carrier is present are no more required and can therefore be omitted.

In accordance with another advantageous embodiment of the invention, a ratio of a nominal diameter of each circumferential stamping section of the stamping cylinder over a nominal diameter of each circumferential pressing element of the counter-pressure units is an integer multiple. This is of advantage in that there is no risk that any undesired transfer of residues from the sheets (such as ink residues) on the surface of the circumferential pressing element(s) is transferred back onto a different location of the sheets, which could otherwise cause undesired quality defects on the sheets.

Preferably, each circumferential pressing element is designed as a pressing ring that is supported on a common shaft of the counter-pressure unit. In that context, each pressing ring of the counter-pressure units may advantageously comprise an outer annular supporting portion, which comes into contact with the successive sheets, and an inner portion made of a compressible elastic material, which is located on an inner side of the outer annular supporting portion, which can help to absorb slight variations in the thickness of the circumferential stamping sections. The outer annular supporting portion can conveniently be made of or coated with a material having a pressure resistance of more than 100 N/mm2, preferably greater than 300 N/mm2. A suitable material is in particular Gesadur® of company Sachsenröder GmbH & Co. KG in Wuppertal, Germany (Gesadur® being a registered trademark of Fa. G.H. Sachsenröder).

In accordance with a preferred embodiment of the invention, the counter-pressure units are mounted on a movable carriage that is retractable away from the stamping cylinder during maintenance operations, the movable carriage being preferably slidable along a direction parallel to an axis of rotation of the stamping cylinder.

In accordance with yet another preferred embodiment of the invention, a first one of the counter-pressure units located at an upstream end with respect to a direction of rotation of the stamping cylinder is provided with an outer coating made of a deformable material, such as rubber or polyurethane.

Further advantageous embodiments of the invention are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of a sheet-fed stamping press for the production of security documents, such as banknotes. In this context, the sheets are typically provided with a matrix arrangement of multiple security imprints printed on the sheets.

Figure 3:
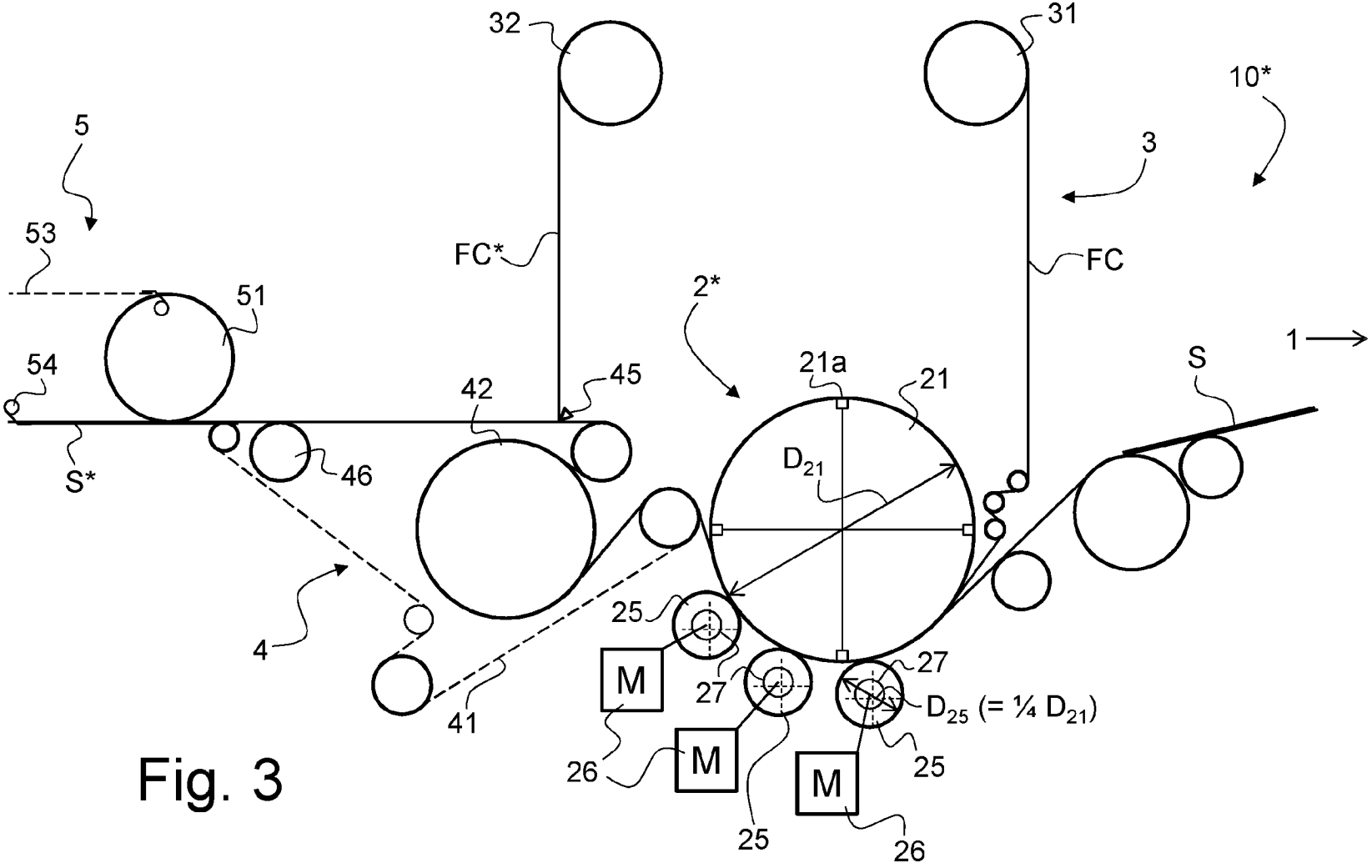
FIG. 3 is a schematic view of a stamping press in accordance with a preferred embodiment of the invention.

FIG. 3 is a schematic diagram of a sheet-fed stamping press 10* in accordance with a preferred embodiment of the invention. Relevant subgroups of the sheet-fed stamping press 10* are basically identical to corresponding subgroups of the sheet-fed stamping press 10 shown in FIG. 1, namely the sheet feeder 1, the foil feeding system 3, the conveyor system 4 and the delivery unit 5. Components of the stamping press 10* of FIG. 3 that are designated by the same reference numerals as in FIG. 1 will not be described again, it being to be appreciated that some of these components are not directly impacting the invention. In particular, the construction of the conveyor system 4 and delivery unit 5 shown schematically in FIG. 3 does not directly affect the invention and other solutions could be contemplated in order to ensure transfer of the sheets S and foil carrier FC away from the stamping cylinder 21 of the stamping press 10*.

Figure 1:
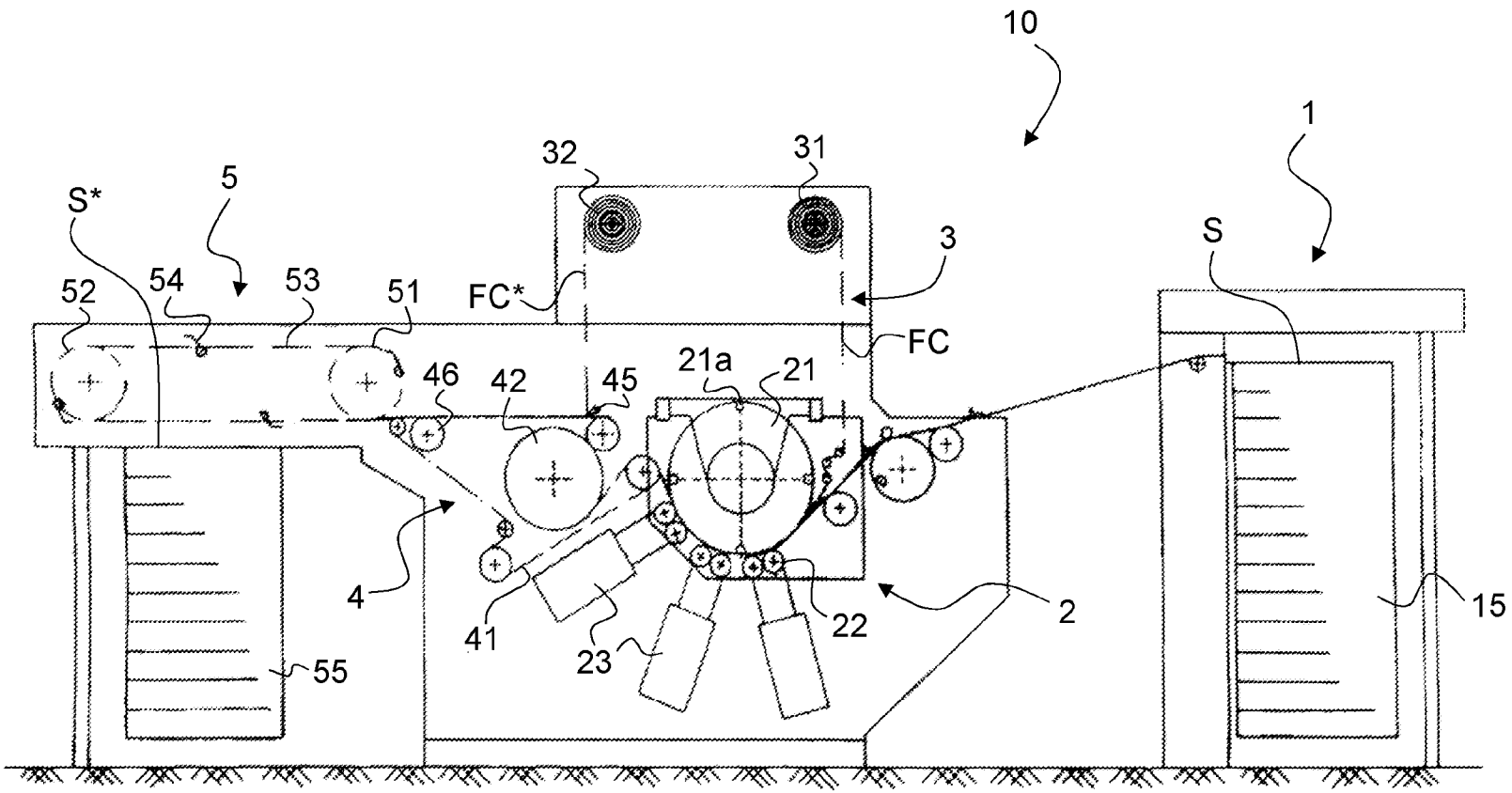
Fig. 1 (PRIOR ART)
FIG. 1 is a schematic side view of a known stamping press.
Figure 2:
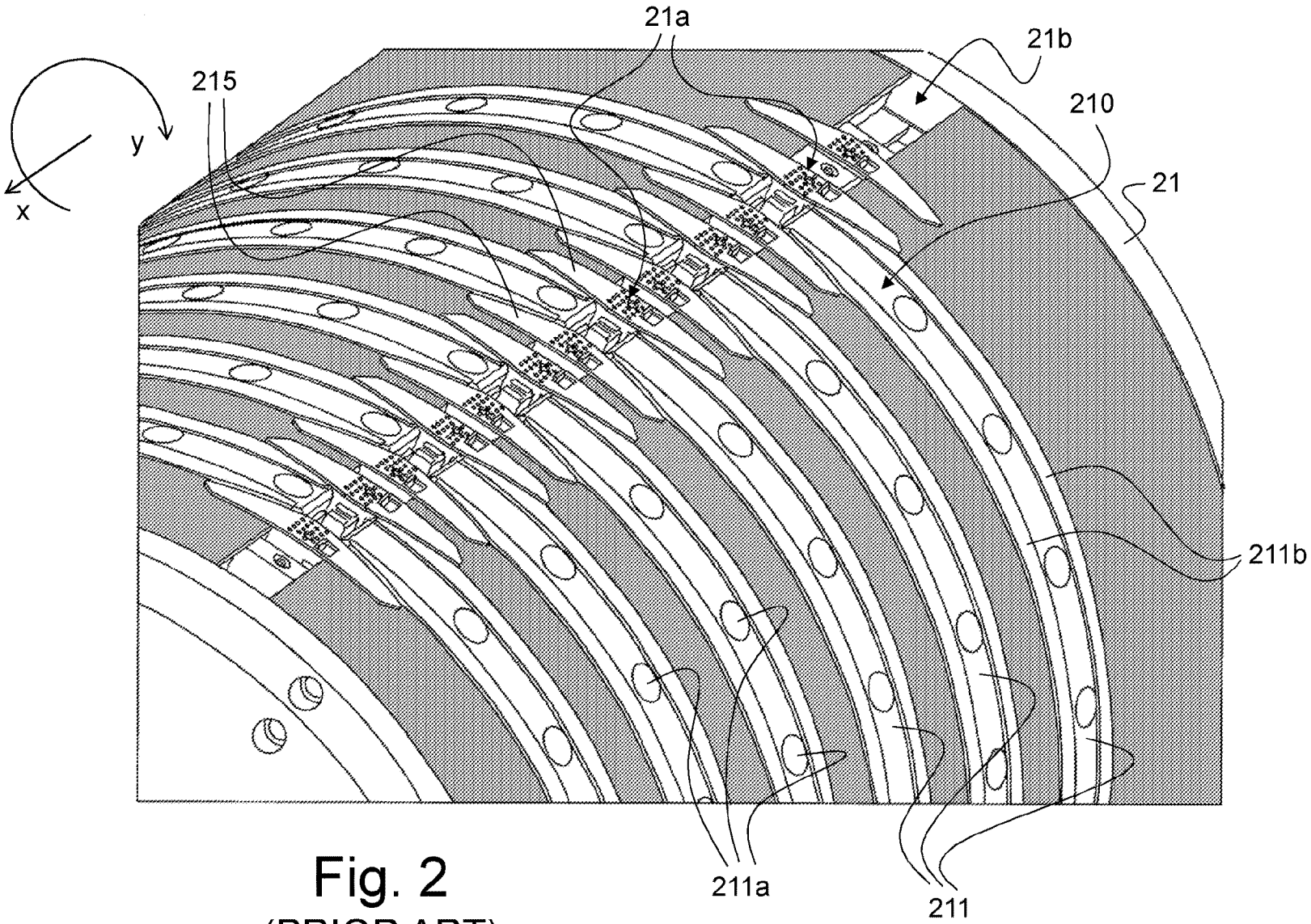
Fig. 2 (PRIOR ART)
FIG. 2 is a partial perspective view of a known stamping cylinder as used in the stamping press of FIG. 1.

The stamping press 10* of FIG. 3 is in particular characterized in that it comprises a foil application unit, designated by reference numeral 2*, including a stamping cylinder 21 that is basically similar to the stamping cylinder 21 of FIG. 1. This stamping cylinder 21 is likewise provided with at least one circumferential stamping section 210 provided on a circumference of the stamping cylinder 21 and comprising successive stamping segments 211* or 211 (shown schematically in FIGS. 4***a* and 4*b*) distributed one after the other about the circumference of the stamping cylinder 21. Like in the prior art example of FIGS. 1 and 2, the stamping cylinder 21 is a four-segment cylinder and acts as sheet-transporting cylinder. The stamping cylinder 21 therefore likewise comprises multiple sheet holding units 21*a* distributed about the circumference of the stamping cylinder 21 and designed to hold the successive sheets S against the circumference of the stamping cylinder 21.

Figure 5:
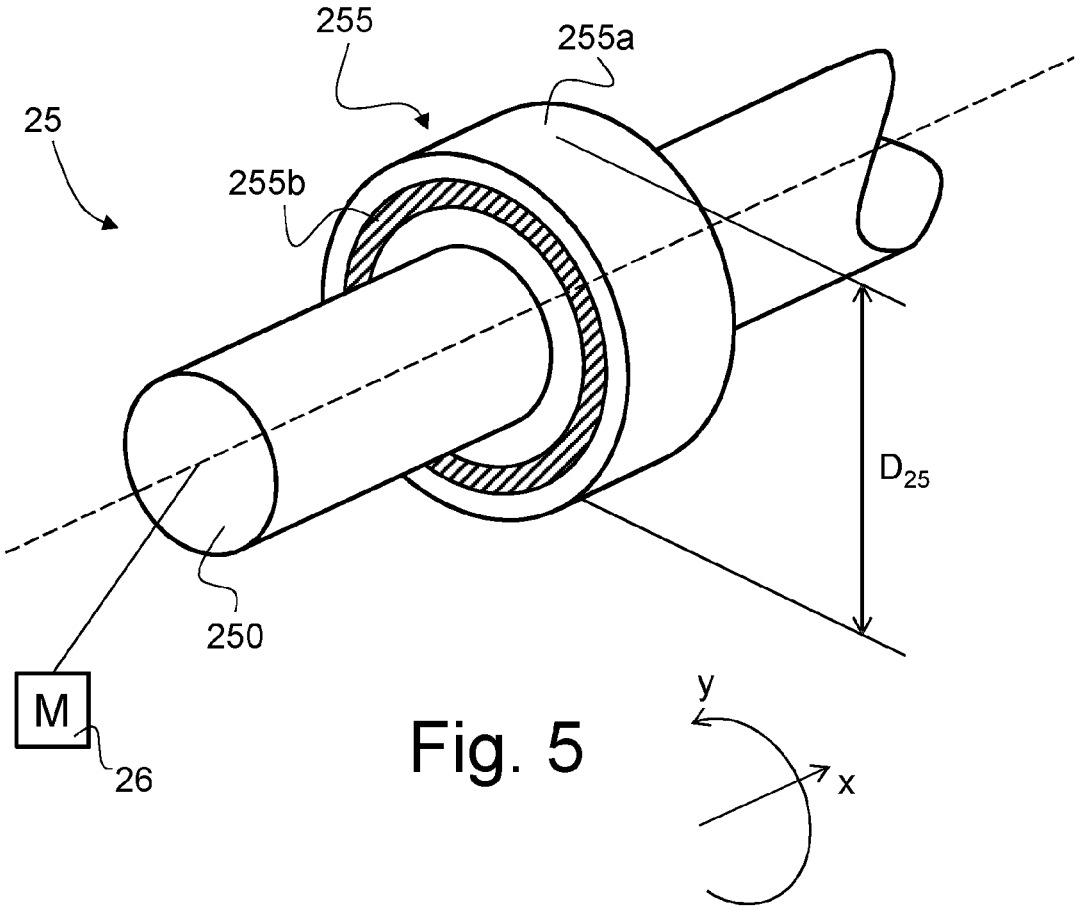
FIG. 5 is a schematic partial perspective view of a preferred counter-pressure unit suitable for use as part of the counter-pressure system of the stamping press of the invention.

A main difference resides in the structure and operation of the counter-pressure system that cooperates with the stamping cylinder 21 and is used to exert pressure on the sheets S. In the preferred embodiment, multiple counter-pressure units 25 (namely three in the illustrated example) are distributed about a portion of the circumference of the stamping cylinder 21. These counter-pressure units 25 extend in parallel to the axis of rotation of the stamping cylinder 21 and are designed to press the successive sheets S and the foil carrier FC against the outer surface of the stamping segments **211*/211**. In contrast to the known solution, each counter-pressure unit 25 is designed as a cylinder unit 250/255 (see FIG. 5) that is provided with at least one circumferential pressing element 255—namely as many circumferential pressing elements 255 as there are circumferential stamping sections 210—positioned to cooperate with the circumferential stamping section 210 of the stamping cylinder 21. As schematically shown in FIG. 5, the circumferential pressing elements 255 of each counter-pressure unit 25 are preferably designed as pressing rings that are supported on a common shaft 250, whose axis of rotation is parallel to the axis of rotation of the stamping cylinder 21. In this context, an axial position of each pressing ring along the common shaft 250 is advantageously adjustable so as to allow positioning of each circumferential pressing element 255 in dependence of the axial positions of the circumferential stamping sections 210 on the stamping cylinder 21**.

By way of alternative, the circumferential pressing elements 255 could be designed as multiple pressing sections provided on the circumference of a suitable sleeve or plate member mounted on a cylinder body acting as counter-pressure unit 25. In that context, the sleeve or plate member could for instance be provided with a number of relief portions acting as circumferential pressing elements and made of a material suitable for that purpose. Such material could in particular be Gesadur® material as commercially available from company Sachsenröder GmbH & Co. KG in Wuppertal, Germany (Gesadur® being a registered trademark of Fa. G.H. Sachsenröder).

Figure 6A:
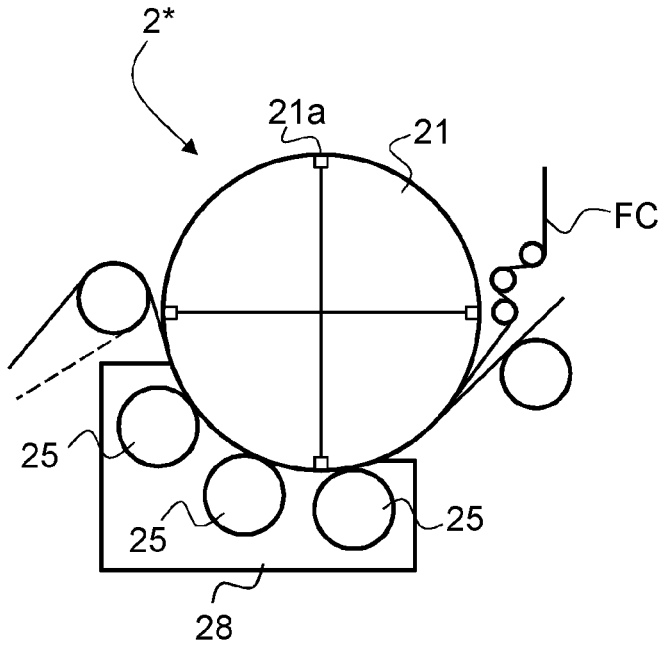
FIGS. 6*a* and 6*b* are schematic side and top views, respectively, illustrating a refinement of the foil application unit of the stamping press of FIG. 3.
Figure 6B:
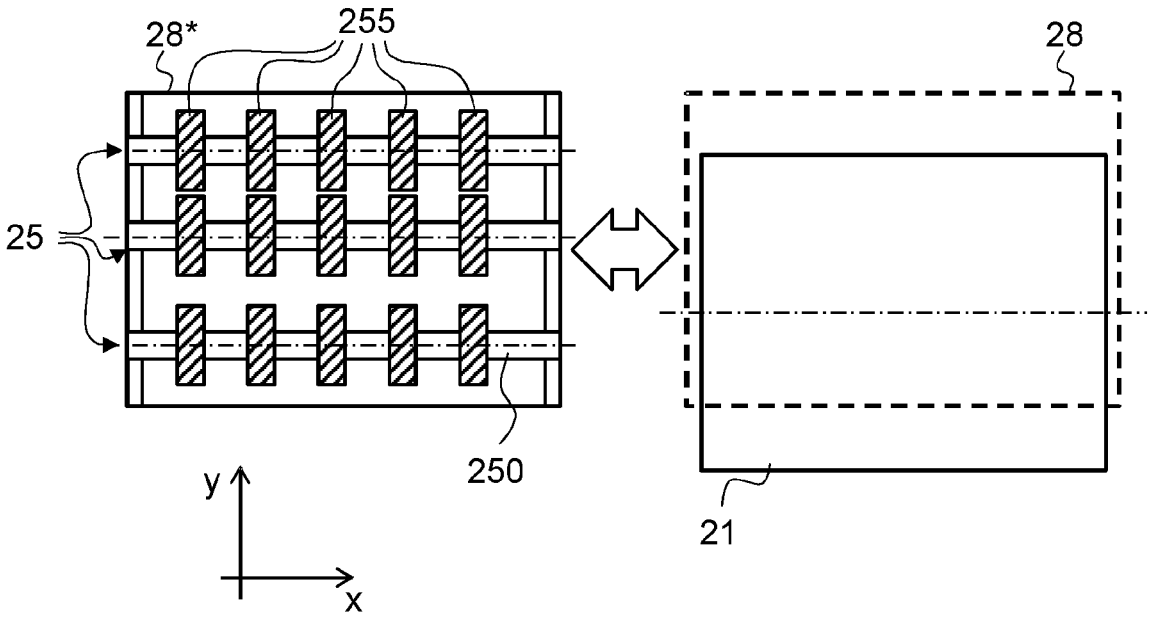

In the event that the stamping cylinder 21 comprises a plurality of circumferential stamping sections 210 provided on the circumference of the stamping cylinder 21, which circumferential stamping sections 210 are distributed axially along an axis of rotation of the stamping cylinder 21 at a plurality of axial positions, each counter-pressure unit 25 is likewise provided with a plurality of circumferential pressing elements 255 that are distributed axially along an axis of rotation of the cylinder unit 250/255 at a plurality of axial positions corresponding to the axial positions of the circumferential stamping sections 210 of the stamping cylinder 21 (see e.g. FIG. 6*b*). In such a situation, the foil feeding system 3 is adapted to feed multiple foil carriers FC at a plurality of axial positions corresponding to the axial positions of the circumferential stamping sections 210.

According to the invention, the counter-pressure units 25 are driven into rotation by means of at least one dedicated drive. This can be a common drive driving all counter-pressure units 25 or, preferably, as schematically illustrated in FIG. 3, separate drives 26, such as servo-motors, each driving a corresponding one of the counter-pressure units 25. Advantageously, a rotational speed or angular position of each counter-pressure unit 25 is adjustable with respect to a rotational speed or angular position of the stamping cylinder 21. This helps adjusting operation of the counter-pressure units 25 to improve transport of the sheets S and ensure optimal transfer of the foil material from the foil carrier FC onto the sheets S. This also allows adequate repositioning—if need be—of the individual counter-pressure units 25 from one stamping segment **211*/211**** to the next.

Figure 4A:
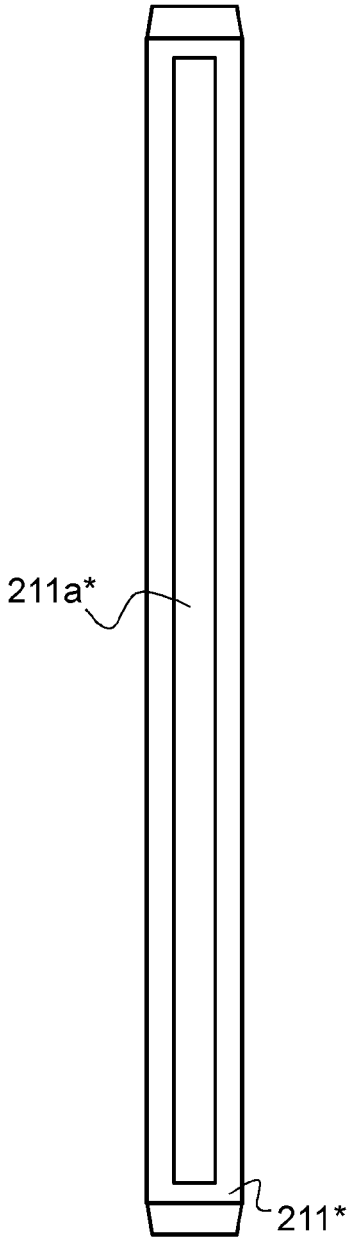
FIG. 4*a* is a schematic view of a stamping segment suitable for stripe application of foil material in the context of the invention.
Figure 4B:
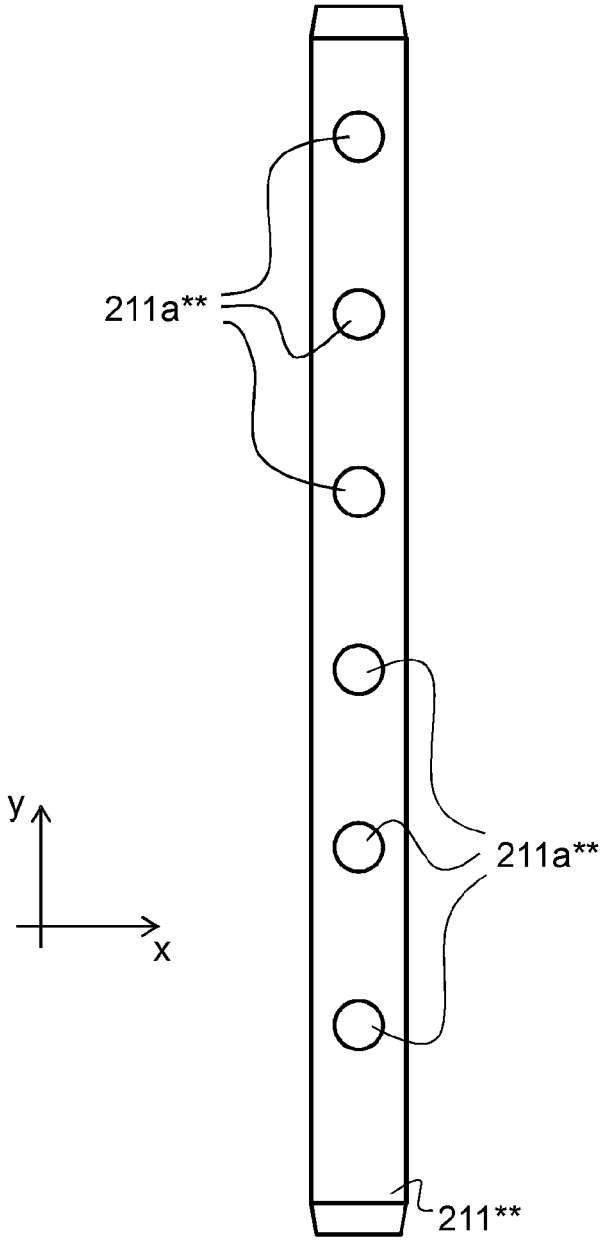
FIG. 4*b* is a schematic view of a stamping segment suitable for patch application of foil material in the context of the invention.

As shown in FIGS. 4*a* and 4*b*, each stamping segment **211*/211** comprises one or more stamping surfaces 211*a/211*a** coming into contact with corresponding portions of the foil carrier FC corresponding to the foil material to be transferred onto the sheets S. FIG. 4***a* shows a structure of a stamping segment 211* used for stripe application. In this case, the stamping segment 211* comprises a continuous stamping surface 211*a designed to allow application of a continuous stripe of foil material onto the successive sheets S. FIG. 4***b* shows a structure of a stamping segment 211 used for patch application. In this other example, the stamping segment 211*a comprises one or more individual stamping surfaces 211*a designed to allow application of one or more corresponding portions (or patches) of foil material onto the successive sheets S. In the illustrated example, six individual stamping surfaces 211*a** are provided, which would be convenient for patch application onto sheets S carrying six rows of security imprints. It will understood that the number and position of the relevant stamping surfaces depends on the particular layout of the sheets S to be processed.

Preferably, and in contrast to the known solutions, a distance of each counter-pressure unit 25 with respect to the circumference of the stamping cylinder 21 is adjustable. That is, each counter-pressure unit 25 is not pressed against the circumference of the stamping cylinder 21 under the action of any pneumatic or hydraulic system as in the known solutions, but a position of each counter-pressure unit 25 per se with respect to the circumference of the stamping cylinder 21 is adjusted. In other words, the resulting pressure exerted by each counter-pressure unit 25 is dependent on the actual position of the cylinder unit 250/255 with respect to the stamping cylinder 21 and the combined thickness of the sheets S and foil carrier FC that are interposed between the counter-pressure unit 25 and the stamping cylinder 21. Such adjustment of the distance of the counter-pressure unit 25 with respect to the circumference of the stamping cylinder 21 is preferably achieved through mounting of each counter-pressure unit on suitable eccentric bearings that are schematically illustrated and designated in FIG. 3 by reference numeral 27.

An adjustment in position of the counter-pressure units 25 with respect to the circumference of the stamping cylinder 21 is especially advantageous in that it does not require the provision of supporting tracks (like the supporting tracks 211*b* shown in FIG. 2) on the stamping segments **211*/211**, as illustrated in FIGS. 4***a* and 4*b*. In other words, and in contrast to the known stamping segments 211 of the prior art shown in FIG. 2, each stamping segment **211*/211** of the invention is advantageously devoid of any supporting tracks coming into contact with the successive sheets S outside of the region where the foil carrier FC is present. Indeed, a continuous support of the cylinder unit 250/255 against the circumference of the stamping cylinder 21 (or more precisely against the circumference of the circumferential stamping sections 210**) is not anymore required in such a case. This is of substantial interest, as the contact surface with the sheets S is considerably reduced, and therefore the friction that comes with it, which helps reducing or even preventing undesired movement or slippage of the sheets S during application of the foil material and furthermore suppresses undesired interactions with the surface of the sheets S on both sides outside of the region where the foil material is applied onto the sheets S.

In accordance with a particularly preferred embodiment of the invention, a ratio of a nominal diameter $D_{21}$ of each circumferential stamping section 210 of the stamping cylinder 21 over a nominal diameter $D_{25}$ of each circumferential pressing element 255 of the counter-pressure units 25 is preferably and advantageously an integer multiple. In the illustrated example this ratio $D_{21}/D_{25}$ is equal to 4. This is particularly advantageous in that there is a one-to-one relationship between the circumference of the circumferential pressing element(s) 255 and each segment of the stamping cylinder 21, i.e. each point of the circumference of the circumferential pressing element(s) 255 always corresponds to a same point on the surface of the sheets (assuming that the stamping cylinder 21 and counter-pressure unit 25 are rotated in synchronism or repositioned at the start of each stamping segment 211*/211). There is therefore no risk that any undesired transfer of residues from the sheets S (such as ink residues) on the surface of the circumferential pressing element(s) 255** is transferred back onto a different location of the sheets S, which could otherwise cause undesired quality defects on the sheets S.

Furthermore, and by way of preference, as schematically illustrated in FIG. 5, each pressing ring (acting as circumferential pressing element 255) of the counter-pressure units 25 advantageously comprises an outer annular supporting portion 255*a*, which comes into contact with the successive sheets S, and an inner portion 255*b* made of a compressible elastic material, which is located on an inner side of the outer annular supporting portion 255*a*. The outer annular supporting portion 255*a* may advantageously be made of or coated with a material having a pressure resistance of more than 100 N/mm$^2$, preferably greater than 300 N/mm$^2$. A suitable material in this context is Gesadur® material as commercially available from company Sachsenröder GmbH & Co. KG in Wuppertal, Germany (http://www.sachsenroeder-.com—Gesadur® being a registered trademark of Fa. G.H. Sachsenröder), which material exhibits a pressure resistance of the order of 300 N/mm$^2$. Gesadur® material is ideally suited in the context of the present invention in view of its material properties, in particular in terms of stability, durability and dirt-repellent properties.

In accordance with another preferred embodiment of the invention as illustrated in FIGS. 6*a* and 6*b*, the counter-pressure units 25 are advantageously mounted (together with the associated drives 26) on a movable carriage 28 that is retractable away from the stamping cylinder 21 during maintenance operations. In the illustrations of FIGS. 6*a* and 6*b*, which are schematic side and top views of a refinement of the foil application unit 2* of the stamping press of FIG. 3, the movable carriage 28 is slidable along a direction parallel to an axis of rotation of the stamping cylinder 21 (i.e. along direction x in FIG. 6*b*), thereby allowing the counter-pressure units 25 to be retracted away from the stamping cylinder 21, without this requiring removal of the stamping cylinder 21 from the stamping press 10* (in FIG. 6*b*, reference numeral 28* designates the moveable carriage 28 moved in a retracted position away from the stamping cylinder 21). This greatly facilitates access to the relevant counter-pressure units 25, in particular for the purpose of adjusting the position of each pressing ring acting as circumferential pressing element 255 or for the purpose of replacing any one of the pressing rings.

As a further refinement of the invention, at least the first one of the counter-pressure units 25 located at the upstream end with respect to a direction of rotation of the stamping cylinder 21 (i.e. the rightmost counter-pressure unit 25 in FIG. 3 or 6*a*) may be provided with an outer coating made of a deformable material, such as rubber or polyurethane (instead of the configuration illustrated in FIG. 5), so as to properly press the sheets S against the circumference of the stamping cylinder 21 and force evacuation of air that may be trapped between the sheets S, the foil carrier FC and the relevant stamping surfaces 211*a*/211*a of the circumferential stamping segments 211*/211****, thereby improving application of the foil material onto the surface of the sheets S. Suitable polyurethane materials can in particular be obtained commercially from company Felix Böttcher GmbH & Co. KG (http://www.boettcher.de).

Various modifications and/or improvements may be made to the above-described embodiments. In particular, while the embodiment discussed above adopt a counter-pressure system made of multiple counter-pressure units that are each driven into rotation by a separate drive, a common drive could be contemplated in order to drive all counter-pressure units into rotation. Even in such a scenario, means could be provided to allow for individual adjustment of the rotational speed or angular position of the counter-pressure units.

Furthermore, the circumferential pressing elements could take any suitable form, in particular be designed as multiple pressing sections provided on the circumference of a suitable sleeve or plate member mounted on a cylinder body acting as counter-pressure unit as mentioned above.

In addition, the movable carriage 28 shown in FIG. 6*a* could alternatively been designed to be retractable away from the stamping cylinder 21 along a direction perpendicular to the axis of rotation of the stamping cylinder 21.

LIST OF REFERENCE NUMERALS USED THEREIN

10 sheet-fed (hot) stamping press (prior art—FIG. 1)
10* sheet-fed (hot) stamping press (preferred embodiment of the invention—FIG. 3)
1 sheet feeder
15 sheet feeding pile
S successive sheets
S* successive sheets with foil material applied thereupon (processed sheets)
2 foil application unit (prior art—FIG. 1)
2* foil application unit (preferred embodiment of the invention—FIG. 3)
FC foil carrier carrying or forming the foil material to be applied onto the sheets S (e.g. hot-stamping foil)
FC* used foil carrier
21 stamping cylinder (e.g. four-segment cylinder)
21*a* sheet holding units distributed about the circumference of the stamping cylinder 21 to hold successive sheets S on the stamping cylinder 21
21*b* cylinder pits where sheet holding units 21*a* are located
210 circumferential stamping sections provided on circumference of stamping cylinder 21 and extending in the circumferential direction y/multiple circumferential stamping sections are distributed axially along an axis of rotation (transverse direction x) of the stamping cylinder 21 at a plurality of axial positions
$D_{21}$ nominal diameter of stamping cylinder 21, i.e. of circumferential stamping sections 210
211 plurality of (e.g. four) successive stamping segments distributed one after the other about the circumference of the stamping cylinder 21 and jointly forming a circumferential stamping section
210 (prior art—FIG. 1)
211*a* stamping surface(s) of stamping segments 211 (which come into contact with the foil carrier FC)
211*b* supporting tracks of stamping segments 211 (which come into contact with the sheets S and provide continuous support for the counter-pressure rollers 22
215 bridge elements provided in cylinders pits 21*b* to ensure continuous support for the counter-pressure rollers from one stamping segment 211 to the next (prior art—FIG. 1)

211* stamping segment forming part of a circumferential stamping section 210 (embodiment of the invention—FIG. 4*a*)

211*a continuous stamping surface of stamping segment 211*** (for stripe application)

211 stamping segment forming part of a circumferential stamping section 210 (embodiment of the invention—FIG. 4***b*)

211*a* individual stamping surfaces of stamping segment 211**** (for patch application)

22 counter-pressure rollers (prior art—FIG. 1)

23 pneumatic cylinders designed to press the counter-pressure rollers 22 against the circumference of the stamping cylinder 21 (prior art—FIG. 1)

25 counter-pressure units/cylinder units (preferred embodiment of the invention—FIG. 3)

250 common shaft of counter-pressure unit 25 supporting the pressing rings that act as circumferential pressing elements 255

255 circumferential pressing element of counter-pressure unit 25 positioned to cooperate with the circumferential stamping section 210 of the stamping cylinder 21/e.g. multiple pressing rings acting as the circumferential pressing elements 255 are distributed axially along an axis of rotation (transverse direction x) of the counter-pressure unit 25 at a plurality of axial positions

255*a* outer annular supporting portion of pressing ring acting as circumferential pressing element 255 which comes into contact with the successive sheets S

255*b* inner portion of pressing ring acting as circumferential pressing element 255 made of compressible material, which inner portion 255*b* is located on an inner face of the outer annular supporting portion 255*a*

$D_{25}$ nominal diameter of counter-pressure units 25, i.e. of circumferential pressing elements 255 (nominal diameter of the outer annular supporting portion 255*a*—with $D_{21}/D_{25}$ being an integer multiple)

26 drive (e.g. servo motors) used to drive counter-pressure units 25 into rotation (preferred embodiment of the invention—FIG. 3)

27 eccentric bearings of counter-pressure units 25

28 movable carriage supporting counter-pressure units 25 that is retractable away from stamping cylinder 21 during maintenance operations (e.g. axially-slidable carriage)

28* movable carriage 28 in the retracted position (FIG. 6*b*)

3 foil feeding system

31 supply roll for the supply of a foil carrier FC

32 winding-up roll for winding up used foil carrier FC*

4 conveyor system for conveying sheets S and foil carrier FC away from the stamping cylinder 21

41 conveyor belts/bands

42 cooling roller

45 foil detachment device

46 suction drum

5 sheet delivery unit

51, 52 chain wheels

53 endless chains extending between chain wheels 51, 52

54 spaced-apart gripper bars driven by endless chains 53

55 sheet delivery pile x transverse/axial direction (parallel to axes of rotation of stamping cylinder 21 and counter-pressure units 25)

y circumferential direction (sheet transport direction)

The invention claimed is:

1. A sheet-fed stamping press comprising a foil application unit designed to allow transfer or lamination of foil material onto successive sheets, which foil material is fed to the foil application unit in the form of a foil carrier supplied by way of a foil feeding system, the foil application unit comprising:

a stamping cylinder with at least one circumferential stamping section provided on a circumference of the stamping cylinder and comprising successive stamping segments distributed one after the other about the circumference of the stamping cylinder, the stamping cylinder also acting as sheet-transporting cylinder and further comprising multiple sheet holding units distributed about the circumference of the stamping cylinder and designed to hold successive sheets against the circumference of the stamping cylinder; and a plurality of counter-pressure units distributed about a portion of the circumference of the stamping cylinder and designed to press the successive sheets and the foil carrier against an outer surface of the stamping segments, the foil carrier being supplied by the foil feeding system between the sheets and the stamping segments, wherein each counter-pressure unit is designed as a cylinder unit provided with at least one circumferential pressing element positioned to cooperate with the circumferential stamping section of the stamping cylinder, the cylinder unit itself being configured to adjust a distance between the counter-pressure unit and the circumference of the stamping cylinder so that a pressure exerted by the cylinder unit, in use, depends on the presence of the sheet and the foil between the counter-pressure unit and the stamping cylinder, wherein the counter-pressure units are configured to be driven into rotation by way of at least one dedicated drive, wherein the stamping cylinder further comprises a plurality of said circumferential stamping sections provided on the circumference of the stamping cylinder, the circumferential stamping sections being distributed axially along an axis of rotation of the stamping cylinder at a plurality of axial positions, wherein each counter-pressure unit is provided with a plurality of said circumferential pressing elements that are distributed axially along an axis of rotation of the cylinder unit at a plurality of axial positions corresponding to the axial positions of the circumferential stamping sections of the stamping cylinder, and wherein the foil feeding system is adapted to supply the foil carrier at a plurality of axial positions corresponding to the axial positions of the circumferential stamping sections.

2. The sheet-fed stamping press as defined in claim 1, wherein the counter-pressure units are configured to be driven into rotation by way of a common drive or wherein each counter-pressure unit is configured to be driven into rotation by way of a separate drive.

3. The sheet-fed stamping press as defined in claim 1, wherein a rotational speed or angular position of each counter-pressure unit is adjustable with respect to a rotational speed or angular position of the stamping cylinder.

4. The sheet-fed stamping press as defined in claim 1, wherein each stamping segment comprises one or more stamping surfaces coming into contact with corresponding portions of the foil carrier.

5. The sheet-fed stamping press as defined in claim 4, wherein each stamping segment comprises a continuous stamping surface designed to allow application of a continuous stripe of foil material onto the successive sheets or wherein each stamping segment comprises one or more individual stamping surfaces designed to allow application of one or more corresponding portions of foil material onto the successive sheets.

6. The sheet-fed stamping press as defined in claim 4, wherein each stamping segment is devoid of any supporting tracks coming into contact with the successive sheets outside of the region where the foil carrier is present.

7. The sheet-fed stamping press as defined in claim 1, wherein each counter-pressure unit is mounted on eccentric bearings.

8. The sheet-fed stamping press as defined in claim 1, wherein a ratio of a nominal diameter of each circumferential stamping section of the stamping cylinder over a nominal diameter of each circumferential pressing element of the counter-pressure units is an integer multiple.

9. The sheet-fed stamping press as defined in claim 1, wherein each circumferential pressing element is designed as a pressing ring that is supported on a common shaft of the counter-pressure unit.

10. The sheet-fed stamping press as defined in claim 9, wherein an axial position of each pressing ring along the common shaft is adjustable.

11. The sheet-fed stamping press as defined in claim 9, wherein each pressing ring of the counter-pressure units comprises an outer annular supporting portion, which is configured to come into contact with the successive sheets, and an inner portion made of a compressible elastic material, which is located on an inner side of the outer annular supporting portion.

12. The sheet-fed stamping press as defined in claim 11, wherein the outer annular supporting portion is made of or coated with a material having a pressure resistance of more than 100 $N/mm^2$ and/or greater than 300 $N/mm^2$.

13. The sheet-fed stamping press as defined in claim 1, wherein the counter-pressure units are mounted on a movable carriage that is retractable away from the stamping cylinder during maintenance operations.

14. The sheet-fed stamping press as defined in claim 13, wherein the movable carriage is slidable along a direction parallel to an axis of rotation of the stamping cylinder.

15. The sheet-fed stamping press as defined in claim 1, wherein a first one of the counter-pressure units located at an upstream end with respect to a direction of rotation of the stamping cylinder is provided with an outer coating made of a deformable material and/or made of rubber or polyurethane.

16. The sheet-fed stamping press as defined in claim 1, wherein the pressure exerted by the cylinder unit, in use, depends on a combined thickness of the sheet and the foil and the distance between the counter-pressure unit and the circumference of the stamping cylinder when the sheet and the foil are transposed between the counter-pressure unit and the stamping cylinder.

* * * * *